US005938844A

United States Patent [19]

Knop

[11] Patent Number: 5,938,844

[45] Date of Patent: Aug. 17, 1999

[54] SUPPORTING SYSTEM FOR THE METERING COMPONENT OF A COATING DEVICE

[75] Inventor: Reinhard Knop, Essen, Germany

[73] Assignee: Jagenberg Papiertechnik GmbH, Neuss, Germany

[21] Appl. No.: 08/973,415

[22] PCT Filed: Apr. 26, 1997

[86] PCT No.: PCT/EP97/02166

§ 371 Date: Nov. 21, 1997

§ 102(e) Date: Nov. 21, 1997

[87] PCT Pub. No.: WO97/41967

PCT Pub. Date: Nov. 13, 1997

[30] Foreign Application Priority Data

May 2, 1996 [DE] Germany ..... 196 17 458

[51] Int. Cl.[6] ..... B05C 21/00

[52] U.S. Cl. ..... 118/123; 118/126; 118/413; 118/419

[58] Field of Search ..... 118/123, 126, 118/413, 419; 427/356

[56] References Cited

U.S. PATENT DOCUMENTS

| | | | |
|---|---|---|---|
| Re. 33,741 | 11/1991 | Boissevain | 427/10 |
| 4,440,105 | 4/1984 | Jeltema | 118/410 |
| 5,597,415 | 1/1997 | Graf | 118/123 |

FOREIGN PATENT DOCUMENTS

| | | |
|---|---|---|
| 0 651 094 A1 | 5/1995 | European Pat. Off. . |
| WO 93/05887 | 4/1993 | WIPO . |

*Primary Examiner*—Laura Edwards
*Attorney, Agent, or Firm*—Herbert Dubno

[57] ABSTRACT

A support strip is braced against a doctor blade for coating a web and consists of spring steel sheet subdivided by slits into tongues. The tongues are securely clamped at their ends facing away from the dosage element and the continuous frontal edge is supported between guide strips so as to be movable in the direction of the dosage element. Adjustment elements engage at the tongues to cause them to bend perpendicularly with respect to the span of the tongues to control the force applied to the doctor blade.

13 Claims, 5 Drawing Sheets

SUPPORTING SYSTEM FOR THE METERING COMPONENT OF A COATING DEVICE

SPECIFICATION

CROSS REFERENCE TO RELATED APPLICATION

This application is a National Phase of PCT/EP 97/02166 filed Apr. 26, 1997 and based, in turn, on German National Application 196 17 458.9 filed May 2, 1996 under the International Convention.

FIELD OF THE INVENTION

The invention relates to a support system for a dosing or metering element of a coating device, particularly the doctor blade of a coating device for paper or cardboard webs.

BACKGROUND OF THE INVENTION

The known coating devices for paper or cardboard webs have an application mechanism (roller mechanism or nozzle applicators), by means of which the coating material, e.g. coating dye, is applied to the web in excess. A dosing or metering system provided with a dosage element, arranged downstream of the application mechanism, wipes the excess off to leave the desired coating weight. The setting of the coating weight (weight per unit area of the coated web) is done through the contact pressure of the dosage element on the web, which in the coating region is supported by a backing roll.

During the coating of paper or cardboard webs variations of the cross section profile of the webs occur as a result of production conditions, which make it necessary to set the contact pressure of the dosage element over the work width with local differences, in order to achieve an even coating. When a doctor blade is used as the dosage element, the latter is supported at its back side by a support strip pressing from underneath, this strip being bendable within limits and adjustable along the support line by means of tension and compression screws, depending upon whether the coating weight is too high or too low at the respective locations (see German patent document DE-C 2825 907).

A generic support system is known from International patent document W)93/05887, wherein the doctor blade is supported by a flat strip, which is continuous in the area of its frontal edge resting against the doctor blade and has a number of longitudinal slits for sufficient flexibility to allow for different pressure settings of the doctor blade. A lever engages each tongue between two slits and the lever can be actuated via a pneumatic cushion, by means of which the segments of the support strip can be deformed individually in the direction of the doctor blade, in order to set a certain contact pressure.

OBJECTS OF THE INVENTION

It is the object of the invention to improve a generic support system so that with a simple construction locally different contact pressures against a dosage element can be set.

SUMMARY OF THE INVENTION

A according to the invention the support strip consists of a spring steel sheet which has a row of longitudinal slits separating respective tongues from one another. The tongues formed in this way are securely clamped on their side turned away from the dosage element, while the continuous frontal edge is movably supported between guide strips in the direction of the dosage element. Adjustment elements engage at the tongues, which cause the tongues to bend vertically with respect to the span of the tongues. The vertical bending of the tongues with respect to their span leads to a change in their effective length, which due to the clamping on one side and the guidance on the other side translates into a change in the configuration of the frontal edge at the respective location. In this way the contact pressure of the support strip of the dosage element can be modified in this area.

The contact pressure of the dosage element can be produced by means of a row of pressure chambers. Each pressure chamber is connected through a line which is closable by a valve with a common pressure tank, which is connected to a source of compressed air via a controllable valve, particularly a proportional valve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
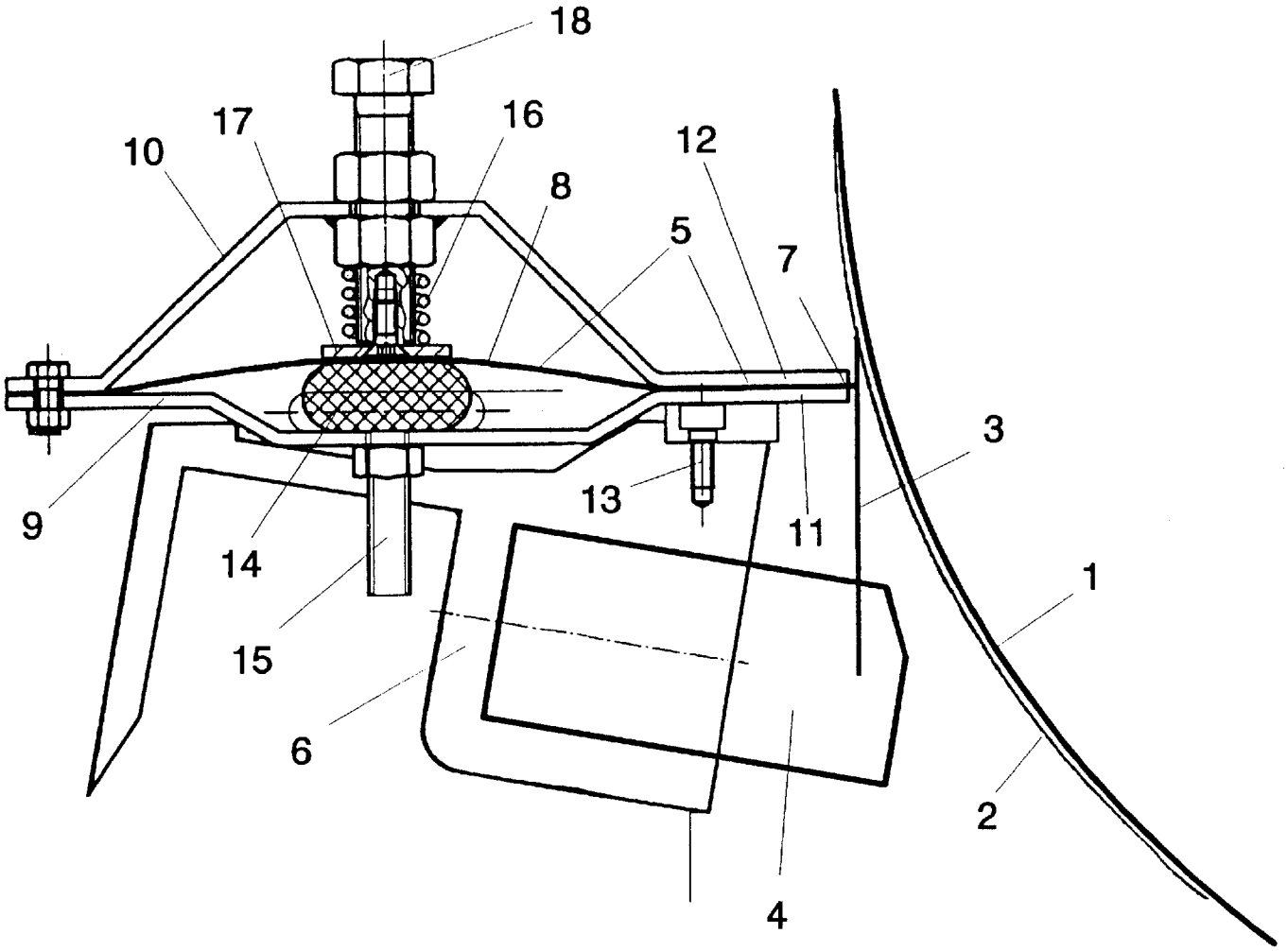
FIG. 1 is a longitudinal section through a support system according to the invention.

The coating device has a driven backing roller 1 along which the material web 2, eg.—a paper or cardboard web with a width of 8 m or more—is guided. An applicator not shown in the drawing has applied to the web 2 a coating material in excess, which is scraped off down to the desired coating weight by a dosage system with a dosage element, preferably an elastically bendable doctor blade 3. The doctor blade 3 is clamped with its base in a clamping beam 4 displaceable in the direction of the backing roller 1. The doctor blade 3 at its side facing away from the backing roller 1 is supported underneath the doctor blade point by a support strip 5, which is elastically bendable within limits in the direction of backing roller 1. Through a relative displacement of the clamping beam 4 towards the support strip 5 extending over the entire work width, it is possible to set the contact pressure of the doctor blade 3 at the backing roller 1.

Figure 2:
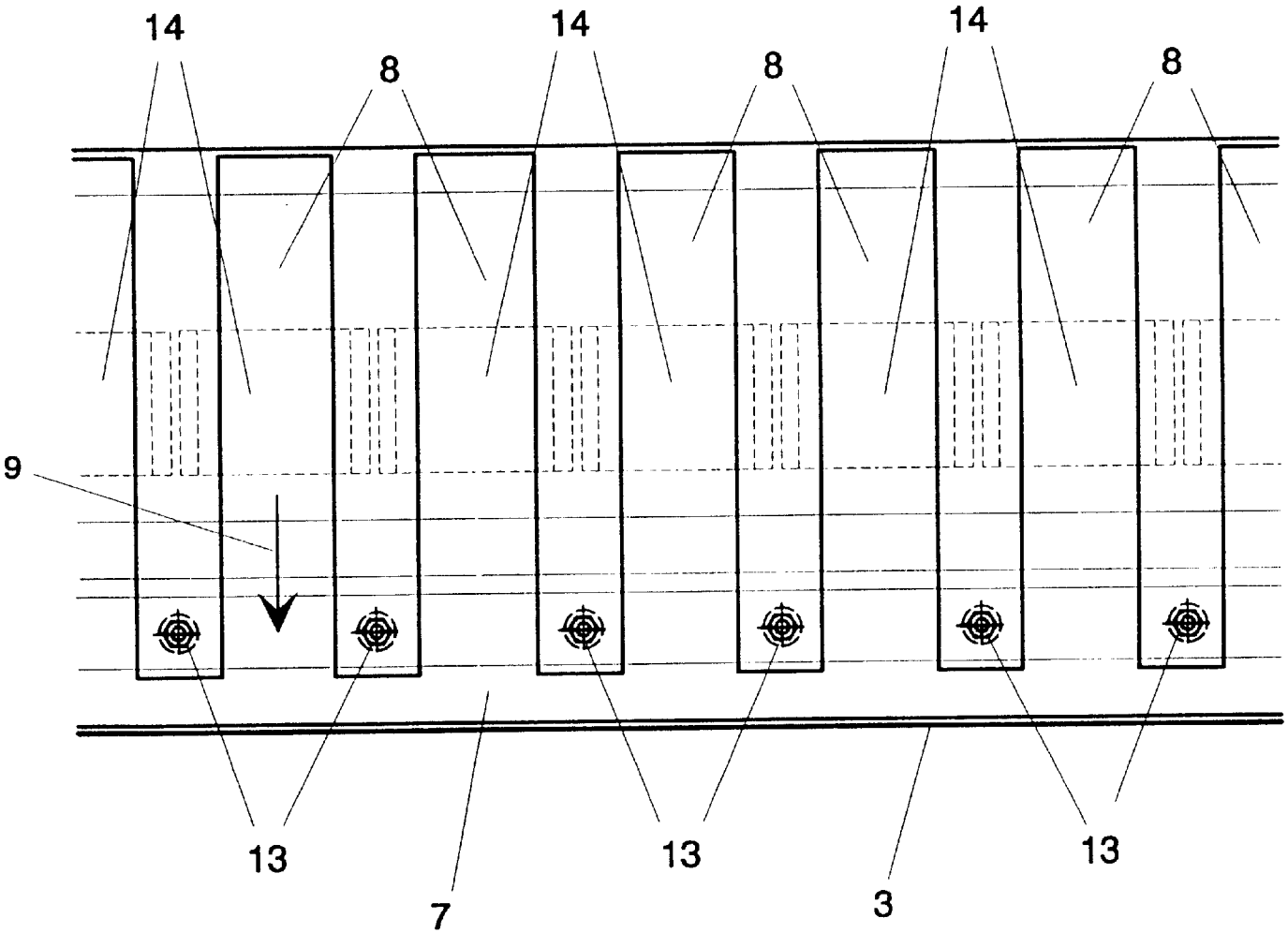
FIG. 2 is a top view of the support system according to FIG. 1.

The support strip 5 is the essential part of the support system, and is fastened on the upper side of a scraper beam 6 supported in a known manner so that it can swing with respect to the backing roller 1, and also carrying the clamping beam 4 with the doctor blade 3. The support strip 5 consists of a thin spring steel sheet of a thickness of 0.5 mm to 1.5 mm, preferably approximately 1 mm and of a width of 200 mm–400 mm, preferably approximately 300 mm and of a length expanding over the entire working width, i.e. the maximal web width. The support strip 5 is comb-shaped with a continuous frontal edge 7 of 10 mm–70 mm, preferably approximately 40 mm in width and has a row of tongues 8 separated by longitudinal slits, whose number and distance from each other are selected so that at each 50 mm–150 mm a tongue 8 is available as a setting member. Preferably the tongues 8 have a width of approximately 80 mm and are arranged at a distance of 20 mm from each other. Due to this construction, the frontal edge 7 is sufficiently flexible in the direction of the doctor blade 3 (arrow 9 in FIG. 2), and can be elastically deformed in this direction by the displacement of a tongue 8.

Figure 3:
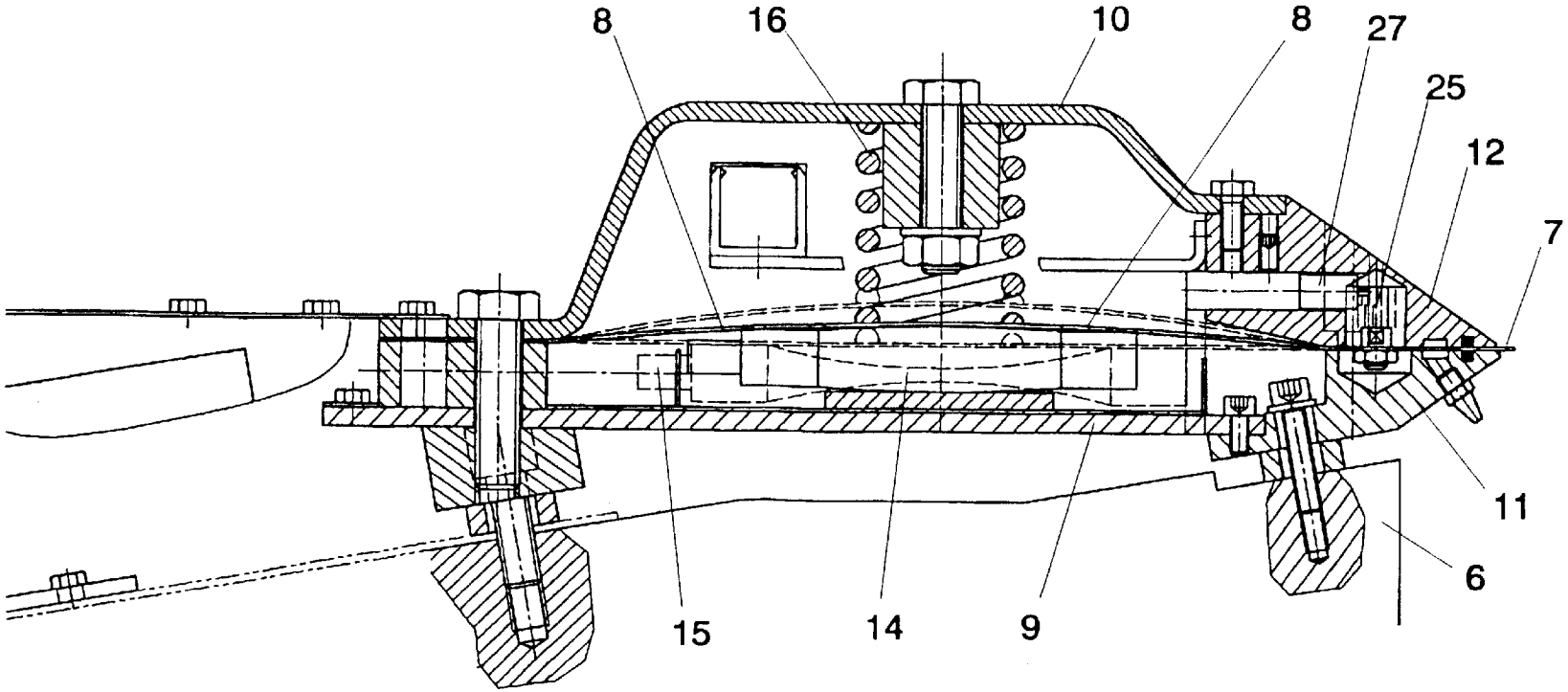
FIG. 3 is a longitudinal section through a support system with a path-measuring device for each setting tongue.

The fastening and adjustment mechanism for the support strip 5 is shown in detail in FIGS. 1 and 3 for two embodiments.

In both embodiments, on the scraper beam 6 a clamping plate 9 extending over the entire working width is fastened, which in it middle section is slightly lowered in the direction towards the scraper beam 6. Above the clamping plate 9 a second clamping plate 10 is arranged, which in its middle section is curved in the opposite sense to the lower clamping plate 9, so that a hollow space is created between the plates 9, 10, wherein a series of adjustment elements can be arranged.

The support strip 5 is arranged between the two clamping plates 9, 10 so that the tongues 8 extend through the hollow space up to ends of the clamping plates 9, 10 facing away from the doctor blade 3. At these ends the two clamping plates run parallel to each other on top of the other, thereby forming two clamping strips, between which the connected ends of the tongues 8 are securely fastened. At the opposite side in the proximity of the doctor blade 3, the clamping plates 9, 10 run also parallel to each other to form the guide strips 11, 12 for the frontal edge 7 of the support strip located in this area. The guide strips 11, 12 are spaced apart by setting screws 13; the spacing is slighly greater than the thickness of the support strip 5, so that the frontal edge 7, slightly protruding from the guide strips 11, 12 and supported between them, can move back and forth in the direction of the doctor blade 3.

In the middle section between the clamping plates 9, 10, an adjustment element engages at each tongue 8, by means of which the respective tongue 8 can be bent vertically with respect to its own span i.e, deflected in a direction perpendicular to the tongues. The bending of a tongue perpendicularly with respect to its own span (in the FIGS. 1 and 3 upwards and downwards) leads to a change of its effective length, which has the effect of changing the configuration of the frontal edge due to the clamping on one side and the guidance on the other side, i.e. the contact pressure of the support strip 5 on the doctor blade is changed in this area.

In the middle section of the clamping plates 9, 10, underneath each tongue 8 a pneumatic cushion 14 (FIG. 1) is arranged which rests on the lower clamping plate 9 and which can be actuated by compressed air via a supply line 15, in order to cause the tongue 8 to bend upwards. Each tongue 8 is pressed at its assigned pneumatic cushion 14, downwards against the compression cushion 14, by a compression spring 16 braced against the upper clamping plate 10.

In the embodiment according to FIG. 1 at the lower end of the spring 16 a retaining plate 17 is fastened, which presses against the tongue 8. The compressive stress and effect of the spring 16 can be set by a setting screw 18.

Since a bending of the tongues 8 is executed perpendicularly to their plane, the adjustment elements (pneumatic cushion 14, spring 16) can also be arranged in a mirror-image fashion with respect to this plane. Then the pneumatic cushion 14 is located above and the spring 16 underneath the tongues 8.

In the embodiment according to FIG. 3 the guiding strips 11, 12 are designed as separate components from the clamping plates 9, 10 and are fastened to the latter. The compression springs 16 press directly against the tongues 8, without an intermediate retaining plate. In addition, in the area between the adjustment element (pneumatic cushion 14, spring 16) and the continuous frontal edge 7, for each tongue 8 a path-measuring device 25, 26, 27 is provided, which measures the motion of the respective tongue 8 from a reference position in the direction of the doctor blade 3 and back. Preferably the path-measuring devices are arranged in the area of the two guide rails 11, 12 where the tongues 8 are securely guided safely against bending and are measured close to the frontal edge 7. At this location the measuring devices measure directly the displacement of the frontal edge 7 in the direction of the doctor blade 3, without being influenced by hysteresis effects.

Figure 4:
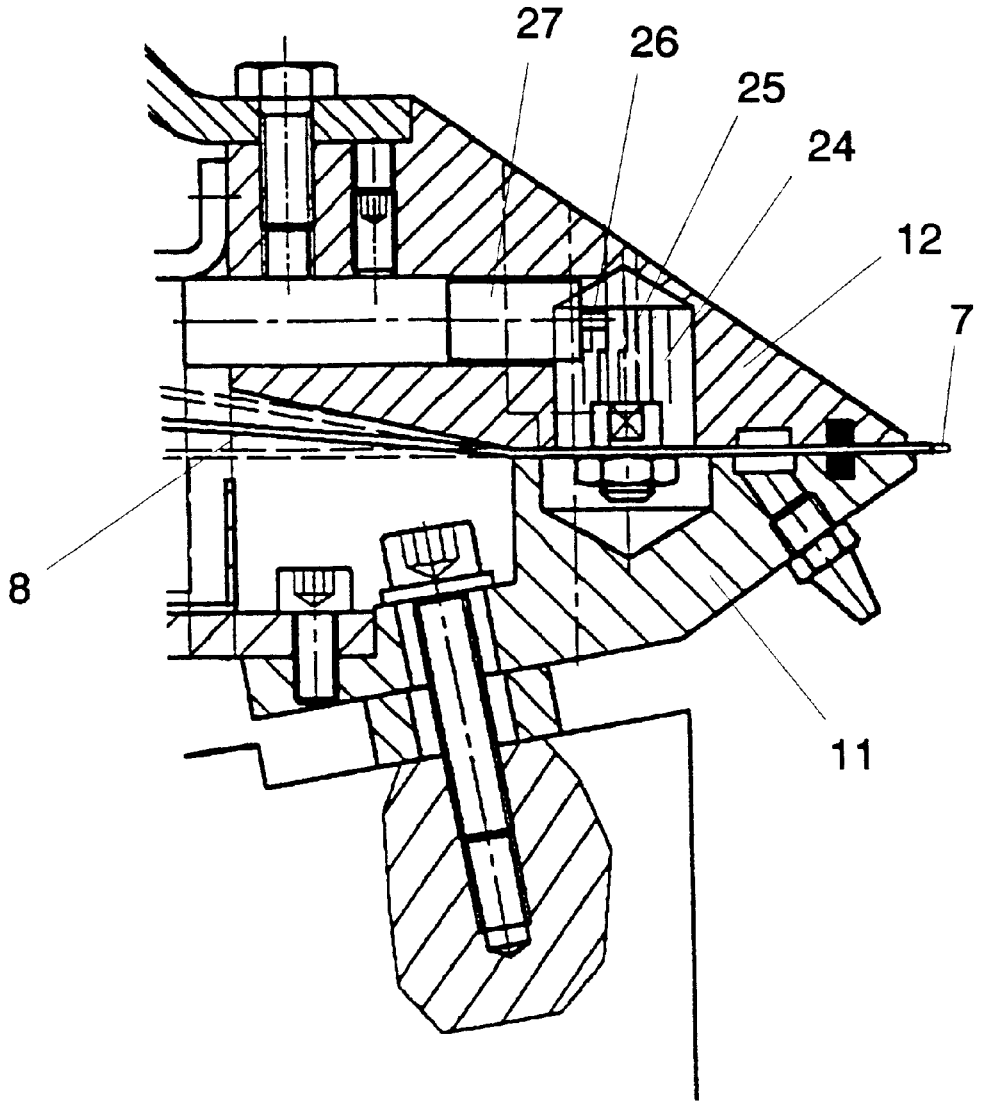
FIG. 4 is an enlarged cutout of FIG. 3.
Figure 5:
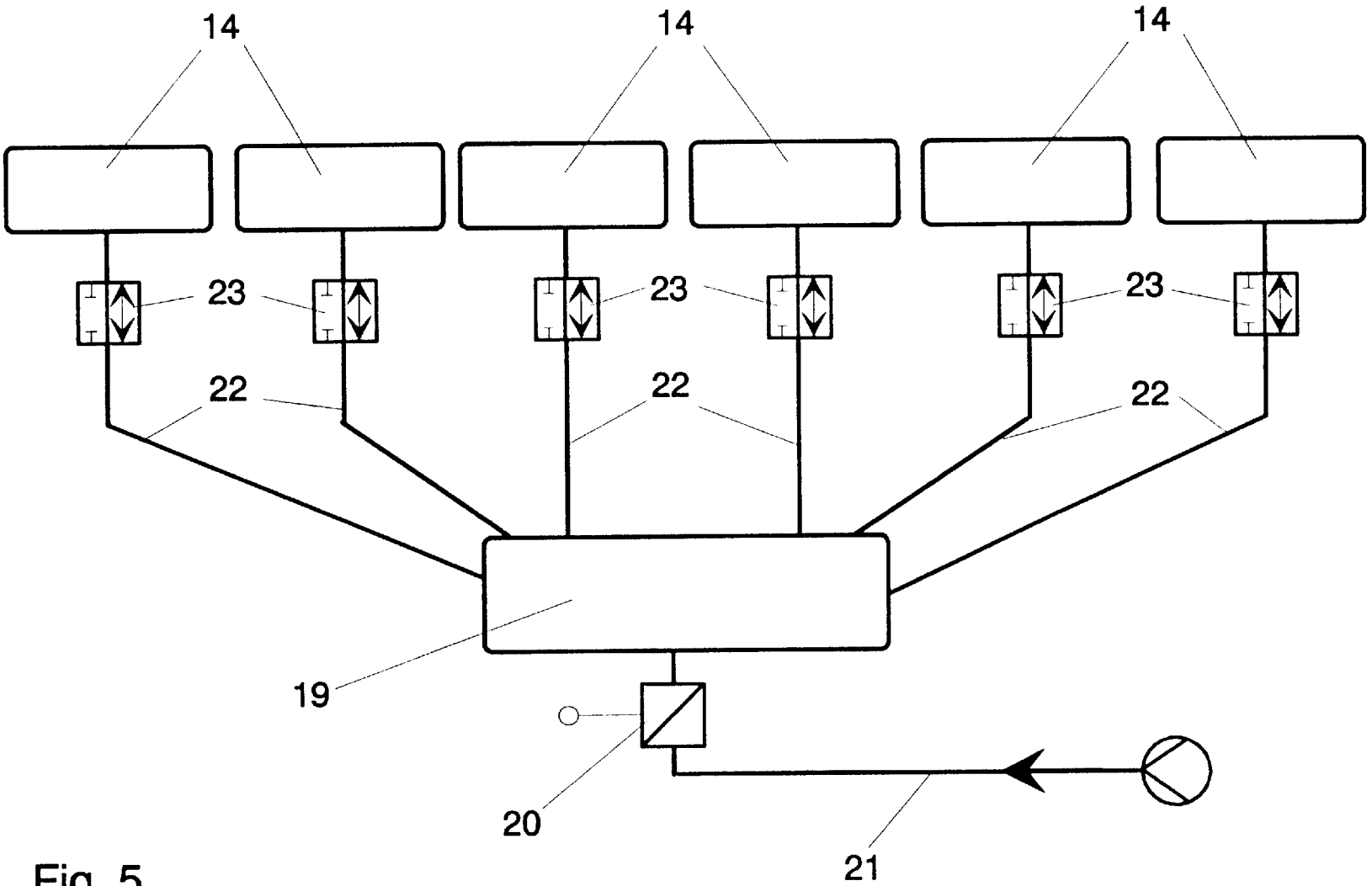
FIG. 5 is a diagram which shows the principle of the control system for controlling the contact pressure.

In the embodiment according to FIG. 3 and FIG. 4 the path-measuring devices are arranged within the guide strips 11, 12 in a hollow space 24 extending all across the working width through which the tongues 8 are guided. To each tongue 8 a measuring bolt 25 extending vertically upwards is attached by a screwthread, the bolt being also displaced when the tongue 8 is displaced. On its back side (in FIG. 4 to the left) facing away from the doctor blade 3 the measuring bolt 25 has a flat lateral surface, against which an axially slidable measuring pin 26 is pressed with its frontal surface by means of a spring. The measuring bolt 25 thus transmits the motion of the tongue 8 to the measuring pin 26. The measuring pin 26 moves with its end facing away from the measuring bolt 25 in a magnetic coil 27 and changes the inductivity of the latter depending on the position of the pin.

As a result with the path-measuring device 25, 26, 27 the position of each tongue 8 directly preceding the frontal edge 7 of the support strip 5, and thereby the position of the frontal edge 7 itself, can be determined in the respective setting location and reproduced. So for instance when the coating device is started again, it is possible to reset a once established advantageous position of the support strip 5 in separate areas of its frontal edge 7.

Preferably the contact pressure system is set prior to the start of the coating operation so that each pneumatic cushion 14 presses its tongue 8 against the force of the pertaining spring 17 half-way up the perpendicular displacement path. This position, shown in FIG. 3 by a continuous line, makes it possible either to push each tongue 8 either further upwards, in order to withdraw in this area the frontal edge 7 of the support strip 5 from the doctor blade 3, or to lower the pressure in the pneumatic cushion 14, so that the compression spring 16 presses the tongue 8 downwards, this way pressing in this area the frontal edge 7 in the direction of the doctor blade 3, so that the contact pressure is increased in this area. If during coating an uneven cross profile of the coating weight occurs, then by changing the pressure in the corresponding pneumatic cushions 14 the contact pressure of the support strip 5 against the doctor blade 3 is either increased or reduced in the respective areas, until an even coating profile is achieved.

FIG. 4 shows schematically the control system by means of which, with a minimal number of control elements, the desired pressure can be established in each pneumatic cushion 14. This system can be used not only in the support system of the invention, but also in other systems wherein several pressure chambers are supposed to be actuated with different pressures. The use thereof is particularly advantageous in coating devices with a dosage system which comprises as a dosage element scraper beam supported by a pressure hose, which across the entire work width is subdivided into separate pressure chambers. Such a coating device is described in German Patent 43 41 341.

The control system consists of a common compressed air tank 19, which via a controllable valve, preferably a proportional valve, is connected to a compressed air source 21. Via the valve 20 the desired pressure can be established in the tank 19.

From the tank 19 a line 22 provided with a simple on/off valve 23 branches off to each of the pressure chambers to be actuated with compressed air, in the present example to each pneumatic cushion 14. By opening one valve 23 in the thereto pertaining pressure chamber (pneumatic cushion 14) a pressure corresponding to the tank 19 can be established.

The setting of the individual pressures in the pneumatic cushions 14 takes place so that at first via the proportional valve 20 in the tank 19 an average pressure (for instance 3 bar) is set, whereby the valves 23 to the pneumatic cushions 14 are open. Therefore in each pneumatic cushion 14 also an average pressure is established, whereby each tongue 8 is bent upwards by half its maximum displacement path. The frontal edge 7 of the support strip rests thereby with an average contact pressure against the doctor blade 3. After this the valves 23 between the tank 19 and the pneumatic cushions 14 are closed.

If the coating weight in the individual areas of web 2 is too low, then in these areas the contact pressure of the support strip 5 against the doctor blade 3 has to be lowered, if the doctor blade 3 operates in the so-called rigid-blade manner. This takes place so that at first the pressure in the tank 19 is raised until a corresponding pressure in the pneumatic cushion 14 would cause the required upward deflection of a tongue 8. Subsequently the valves 23 of the pneumatic cushions 14 of the areas where the coating weight is too low are opened. The increased pressure in the corresponding pneumatic cushions 14 leads to an upward deflection of the corresponding tongues 8, and thereby to a lowering of the contact pressure of the doctor blade 3 in these areas, since the tongues 8 in their upward motion withdraw the frontal edge 7 of the support strip 5 from the doctor blade 3. If in other areas the coating weight is too high, then analogously at first the pressure in the tank 19 is lowered to the required value. Subsequently by opening the respective valves 23 the pressure in the desired pneumatic cushions 14 is brought down to the lower value in tank 19. The lower pressure in a pneumatic cushion 14 causes the compression spring 17 to push the respective tongue 8 downwards and therefore the frontal edge 7 of the support strip 5 is pushed in the direction of the doctor blade 3. This leads to an increased contact pressure of the doctor blade 3 and therefore to a lower coating weight in this area.

I claim:

1. A dosing device for the coating of a web which comprises:

a dosing element to be pressed against a web for removing a coating substance on said web to a desired coating weight;

a spring-steel-sheet support strip having a frontal edge formed by a multiplicity of elongated tongues pressing against said dosing element and separated by respective slits;

means for securely clamping a side of said support strip opposite said frontal edge;

guide strips guiding said tongues between them so that said tongues are movable toward and away from said dosing element; and adjustment elements engaging said tongues for bending said tongues selectively in a direction perpendicular to a plane in which said tongues extend.

2. The dosing device defined in claim 1 wherein said adjustment elements are pneumatically actuatable cushions each braced between one of said tongues and a respective one of said guide strips.

3. The dosing device defined in claim 2, further comprising a respective spring pressing each of said tongues against a respective one of said pneumatically actuatable cushions.

4. The dosing device defined in claim 3, further comprising respective means for adjusting a force applied by each of said springs to the respective tongue.

5. The dosing device defined in claim 1, further comprising a respective path-measuring unit in a region of each tongue for determining a position of said edge in the respective region.

6. The dosing device defined in claim 5 wherein each of said path-measuring units is located between the respective adjustment means and said frontal edge and in a region of said guide strips.

7. The dosing device defined in claim 2, further comprising a control system for controlling pressure in said pneumatically actuatable cushions, said control system comprising a compressed-air tank connectable to a compressed air source by a proportional valve, and a line having a closable valve connecting each of said pneumatically actuatable cushions to said compressed-air tank.

8. The dosing device defined in claim 1 wherein said means for securely clamping said side of said support strip opposite said frontal edge includes parts of said guide strip sandwiching said support strip between them, at least one of said support strips forming a compartment receiving said attachment means.

9. A coating apparatus for coating a paper or cardboard web, comprising:

a backing roller for supporting a web coated with an excess of a coating substance to be removed to leave a desired coating weight on said web;

a scraper beam extending along said backing roller;

a doctor blade mounted on said scraper beam, said doctor blade to be pressed against said web for removing excess coating substance on said web to said desired coating weight;

a spring-steel-sheet support strip mounted on said scraper beam and having a frontal edge formed by a multiplicity of elongated tongues pressing against said doctor blade and separated by respective slits;

means for securely clamping a side of said support strip on said support beam opposite said frontal edge;

guide strips on said support beam guiding said tongues between them so that said tongues are movable toward and away from said doctor blade; and adjustment elements engaging said tongues for bending said tongues selectively in a direction perpendicular to a plane in which said tongues extend.

10. The apparatus defined in claim 9 wherein said means for securely clamping said side of said support strip opposite said frontal edge includes parts of said guide strip sandwiching said support strip between them, at least one of said support strips forming a compartment receiving said attachment means, said adjustment elements being pneumatically actuatable cushions each braced between one of said tongues and a respective one of said guide strips and received in said compartment.

11. The apparatus defined in claim 10, further comprising a respective path-measuring unit in a region of each tongue for determining a position of said edge in the respective region.

12. The apparatus defined in claim 11 wherein each of said path-measuring units is located between the respective adjustment means and said frontal edge and in a region of said guide strips.

13. The apparatus defined in claim 10, further comprising a control system for controlling pressure in said pneumatically actuatable cushions, said control system comprising a compressed-air tank connectable to a compressed air source by a proportional valve, and a line having a closable valve connecting each of said pneumatically actuatable cushions to said compressed-air tank.

* * * * *